United States Patent [19]

Hull et al.

[11] Patent Number: 4,712,454

[45] Date of Patent: Dec. 15, 1987

[54] LIFT-TAB CONTAINER OPENER

[76] Inventors: Alan Hull, Apt. 601 600 9th Ave., Seattle, Wash. 98104; Michael J. Yates, 2617 NE. 22nd St., Renton, Wash. 98056

[21] Appl. No.: 897,658

[22] Filed: Aug. 18, 1986

[51] Int. Cl.[4] ..... B67B 7/40

[52] U.S. Cl. ..... 81/3.27; 81/3.55

[58] Field of Search ..... 81/3.25, 3.27, 3.07, 81/3.36, 3.55, 3.09

[56] References Cited

U.S. PATENT DOCUMENTS

| | | | |
|---|---|---|---|
| 3,572,186 | 3/1971 | Dillard . | |
| 4,455,894 | 6/1984 | Roberts . | |
| 4,524,646 | 6/1985 | Kimberlin | 81/3.55 |
| 4,563,919 | 1/1986 | Sellars | 81/3.55 |

*Primary Examiner*—Roscoe V. Parker

[57] ABSTRACT

The subject device comprises two cams structurally supported from a base attachable to a vertical surface. The cams are positioned to interact with the lift-tabs of lift-tab containers as the container is in a vertical position and moved first toward the device and then from it. As the container is moved toward the opener, one cam engages the lift-tab and lifts it to open the container. As the container is moved away from the opener, the other cam depresses the lift tab to approximately its position before the can was opened. The cams are positioned one behind the other in a line perpendicular to the vertical surface. The tab lifting cam extends below the tab depressing cam and is the closer of the two to the base. The end of the lift tab moves below the end of the depressing cam as the container is moved into the opener and raised by the lifting cam. The lifted tab is then engaged and depressed by the depressing cam as the container is moved away from the opener. The depressing cam is above the opening cam and is configured to allow clear visibility of the engagement of the opening cam with the tab.

13 Claims, 11 Drawing Figures

LIFT-TAB CONTAINER OPENER

BACKGROUND OF THE INVENTION

1. Field:

This invention concerns opening metal containers which are commonly in use for holding such liquids as soft drinks, ales and beer. These containers have seals in their tops. The seals are forced into the containers by tabs attached to the tops. The tabs are termed lift tabs and the containers are termed pop-tops. To open such containers the tab is lifted to force the seal into the can and then the tab is returned to a position essentially parallel to the top.

2. Prior Art:

Known prior art has been formed, related to lift-tab openers and openers for such containers, in the following U.S. Pat. Nos.

4,361,251—Detachment Resistant Retained Lever 4,322,016—Proof of Purchase Means for Self Opening Cans 4,524,646—Tab Can Opener Tool Further prior art is my previous patent application, titled Easy Lift Tab Container Opener, Ser. No. 06/828,508 filing date 02/12/86 and now U.S. Pat. No. 4,663,994. The apparatus in the previous application lifts the tab and opens the container but does not return the tab to a position essentially parallel to the container top.

The lift-tabs are generally located in a recess below the upper rim of the container. This makes opening other than manually difficult and manual opening requires considerable dexterity of fingers and thumbs.

Further, it generally entails the use of both hands, one to grip the container and the other to lift and operate the tab.

In many businesses such as soft drink stands, beverage dispensing machine centers, restaurants, cocktail lounges, taverns and the like, containers may be opened in numbers of a score or more each day by one individual.

Other persons, such as women with long decorative fingernails, the aged, physically challenged, or less dexterous for other reasons often find it difficult or impossible to lift the tab sufficiently to break the seal and gain access to the contents.

Therefore, the principal objective of the subject invention is to provide simple means to lift the tab, break the seal, and gain access to the contents of lift-tab containers and return tabs to approximately the unopened position, thus permitting consumption direct from the can, if desired, without the tab interfering with the consumer's nose.

It is a further objective that the invention require a minimum of effort and dexterity in the opening of a lift-tab container.

SUMMARY OF THE INVENTION

The subject opener comprises a base and a structural element extending from the base. The base is generally flat and, in use, is fastened to an essentially vertical support such as a wall or cabinet. The structural element projects essentially perpendicularly from the surface of the base. The cam element further comprises a first cam and a second cam. The first cam functions to raise the tab on a container top sufficiently to cause the seal to be broken out of the top and bent inward into the container, thus opening the container. This occurs when the container, with its top in contact with the opener, the lift tab aligned so that its effective hinge line is parallel to the surface on which the opener is mounted and the container is held in a vertical orientation, and is moved horizontally toward, i.e. into, the opener. After such motion the tab extends generally upward from the container top.

The second cam functions to force the tab back into a position essentially parallel to the can top so that the tab does not interfere with drinking directly from the container. It does this as the container is moved away, i.e. out of, the opener with the container in an essentially vertical orientation and the container motion essentially in a direction at a right angle to the surface on which the opener is attached. The first cam is chisel-like, slides under the tab and raises it behind the second cam as the container is moved into the opener. The second cam is then an obstruction to the tab as the container is removed and forces it to return to close to its original position as the can is removed.

It can be seen from this brief description that the invention meets its objectives. Operation of the device for opening a lift-tab container is simple. Minimal effort and dexterity are required and the tab is returned to near its original position.

BRIEF DESCRIPTION OF THE DRAWINGS

In the following detailed description of the invention reference is made to the accompanying drawings.

It further illustrates orientation and position of the lift tab with respect to the invention prior to opening the container.

Figure 2:
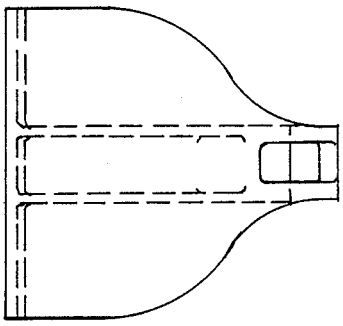

FIG. 2 is a top view of the device showing the mounting surface (base) from above, two support members extending from the base outward to support the top (structural element) of the second cam and a portion of the first cam as seen through the viewing slot of the second cam.

Figure 3:
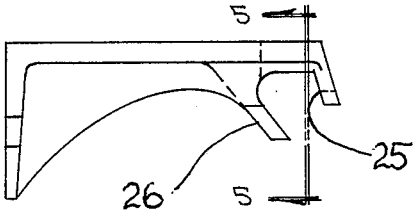

FIG. 3 is a side elevation view of the device, showing the vertical mounting surface (base) with screw attaching slot, the upper surface, a support member, the first cam (narrow version), the second cam and a web having a lift-tab guidance contour.

Figure 4:
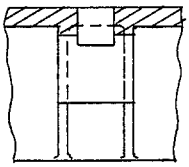
Figure 10:
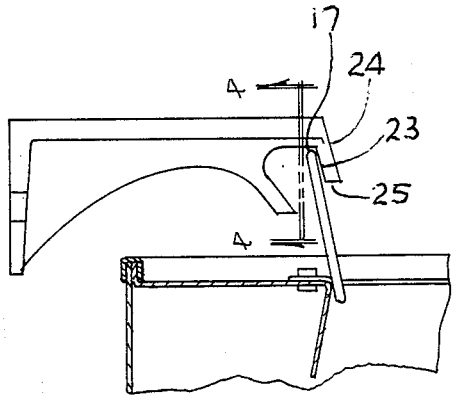

FIG. 4 is a sectional front view of the device taken at 4—4 of FIG. 10. It illustrates a wide version of the first cam.

Figure 5:
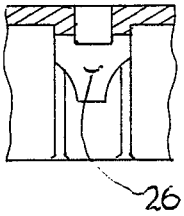

FIG. 5 is a sectional front view of the device taken at 5—5 of FIG. 3. It illustrates a narrow version of the first cam.

Figure 6:
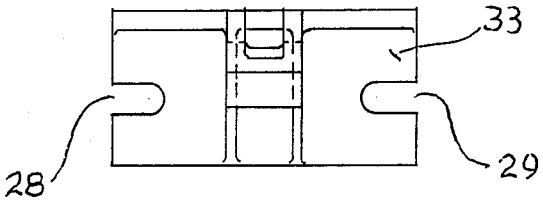

FIG. 6 is a front view of the device illustrating the slots for the mounting screws.

Figure 7:
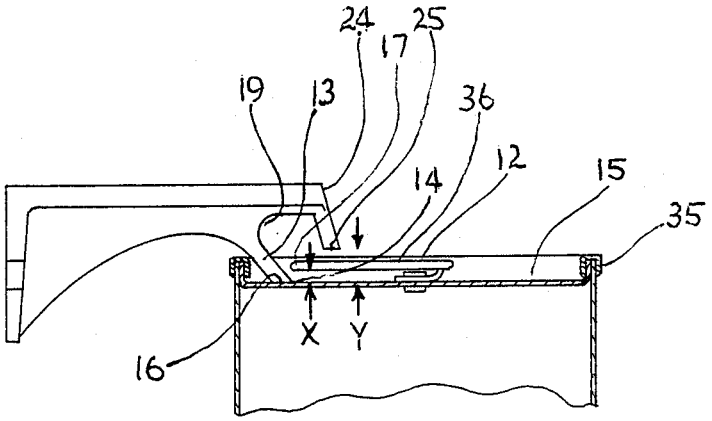

FIG. 7 is a side view of the device with a sectional view of a typical lift-tab can that illustrates the relative position of the wide version of the first cam just prior to the operator moving the container into the devise to raise the lift-tab.

Figure 8:
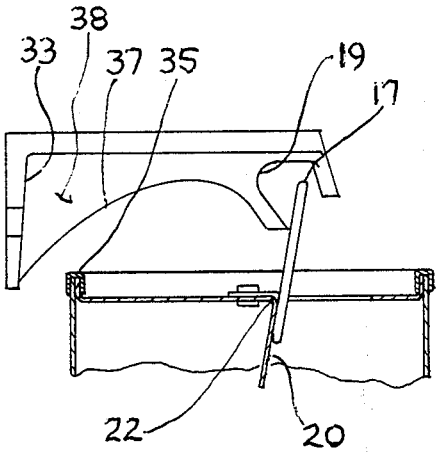

FIG. 8 is a side view of the device together with a sectional view of a typical lift-tab can, illustrating the relative position of the wide version of the first cam at completion of the movement of the can into the opener, with the lift-tab just past the vertical position, the movement of which has caused the can seal to be forced downward within the can and this connected to the can only with the narrow uncoined surface or hinge portion of the outer edge of the seal.

Figure 9:
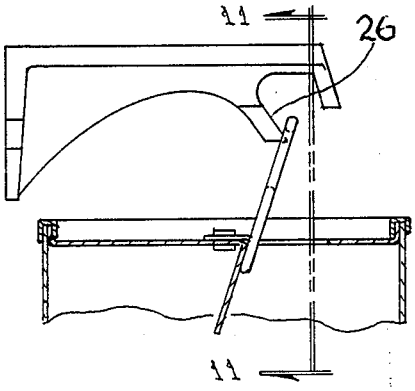

FIG. 9 like FIG. 8, is a side view of the device and can, performing the same basic function as described in FIG. 8 above, with the exception that the first cam is the narrow version as seen in FIG. 5.

FIG. 10 illustrates the beginning of the lift-tab return segment of the operational cycle, as the can is being withdrawn from the device, the completion of which returns the tab to its approximate unopened position as seen in FIG. 7.

Figure 11:
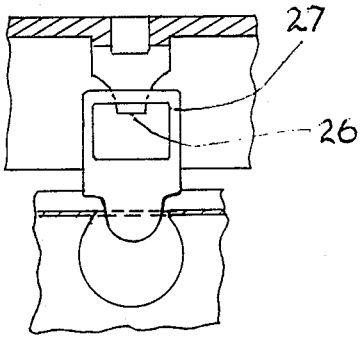

FIG. 11 is a sectional front view of the device, with a sectional view of a typical lift-tab can, illustrating the narrow version of the first cam penetrating a perforated style tab at the completion of the opening portion of the operating cycle with the seal then within the can.

DETAILED DESCRIPTION OF THE INVENTION

Figure 1:
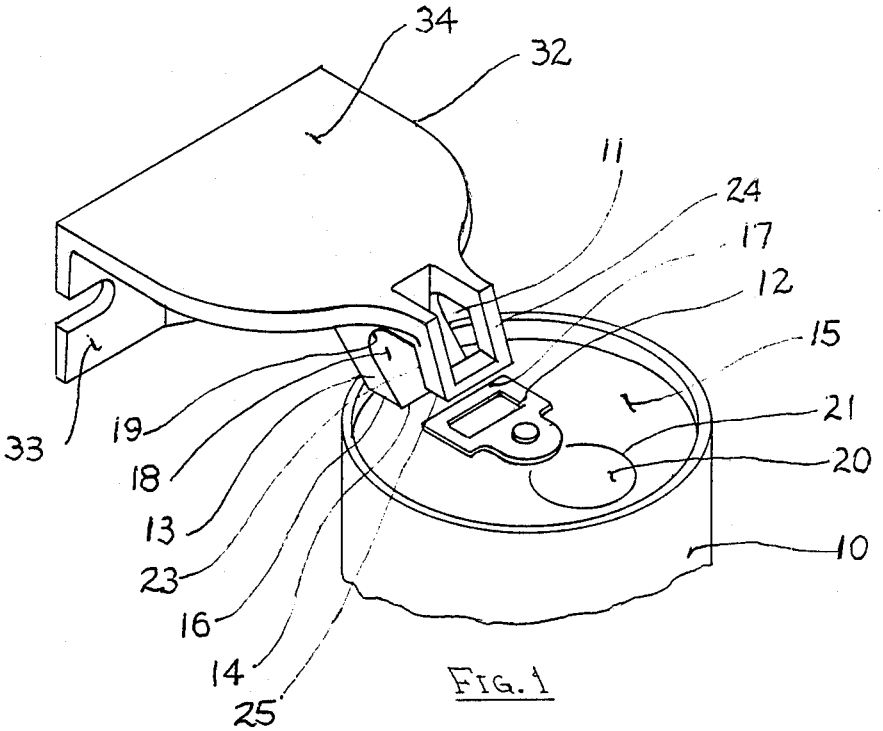
FIG. 1 is an isometric illustration of the subject invention as viewed from above showing the top and one method of fastening the fixture to a vertical surface. It further illustrates the upper portion of a typical lift tab container, the lift tab and the sealing device of the container.

In FIG. 1 a container 10 to be opened is grasped in the hand of an operator (not shown) and, aided by visibility through the viewing slot 11, is maneuvered in such a way as to position the lift-tab 12 toward the first cam 13 and its leading edge 14. The can is then moved toward the leading edge of the first cam until contact is almost made between it, the lift-tab, and the upper surface 15 of the container, thus readying the container for the first step of raising the lift-tab. See FIG. 7.

As the motion of the can directly into the opener continues lower surface 16 of the first cam rides on the upper surface of the container and the end 17 of the lift-tab is caused to raise upward along the sloping surface 18 of the first cam through and past the contour connecting surface 19 to beyond the vertical position as seen in FIG. 8. This causes the seal 20 of the can to be broken along its coined edge 21 thus opening the can. The seal at that point is connected to the can only by a narrow hinge section of uncoined surface 22 common to all lift-tab designs for the purpose of seal retention as seen in FIG. 8.

At this point the motion of the can directly into the device has reached the necessary limit of its travel. This condition is announced by an audible sound of and the sight of the seal breaking. Then, the can is withdrawn from the opener by reversing the direction of the movement of the can during which moment the end of the lift tab engages the sloping undersurface 23 of the second cam 24 as shown in FIG. 10. Further withdrawal of the can causes the lift-tab to pass under end 25 of the second cam and be depressed approximately to its unopened position as seen in FIG. 7. This completes the opening function and depression of the lift-tab approximately to its unopened position and, since the tab is again almost flat against the can top, the contents are ready to be poured or consumed, directly from the can.

To allow for the use of different strength molding resins in manufacture and for variables in eye appeal two embodiments of first cams have been designed: a wide embodiment 13, as seen in FIGS. 1, 4, 6, 7, 8, & 10 and a narrow embodiment 26, as seen in FIGS. 3, 5, 9, & 11.

The narrow embodiment projects through the perforation 27 which is found in most lift tabs. However, the wide embodiment is the preferred one since not all tabs are perforated.

Referring to FIG. 6, where heavy usage of the opener is anticipated, note that the opener is attachable to a support surface (not shown) by inserting screw fasteners in slots 28 and 29 in base 33. For installations where only moderate use of the opener is anticipated (such as in the home), base 33 is of sufficient area to permit high integrity attachment through the use of two sided adhesive tape such as 3-M #1046 or a product of similar or superior characteristics.

It will be noted in FIG. 1 that structural element 32, which supports the cams from the base 33 is made wide and relatively flat. The wide, relatively flat top surface 34 is thus available for the placement of advertising, logo display use and the like.

The operation of the opener can be understood in more detail with reference to FIGS. 7, 8 and 10. In FIG. 7, showing the container engaged with the opener and ready for opening, bottom 16 of first cam 13 is in contact with top surface 15 with edge 14 under end 17 of lift tab 12. The first cam extends over the external rim 35 of the container. The tab is shown a distance X from the top surface. In practice, this distance varies from near zero to approximately one tenth of an inch. The top surface 36 of the tab is flush with or slightly below rim 35 and end 25 of second cam 24 is distance Y from the top surface to facilitate engagement of the container with the opener.

In FIG. 8 the container has been opened, the container held essentially vertical, has been moved toward base 33 and somewhat downward, with the path of the portion of rim 35 closest to the opener essentially paralleling contour 37 of web 38.

In FIG. 10, the removal of the container from the opener is in process with the container essentially retracing the path of motion for the opening. The container is still held essentially vertical and slight upward force is applied on it as it is moved away from the base to assure that end 17 is positively engaged by the second cam and that the tab is depressed into a position essentially parallel to the top surface of the container.

It is considered to be clear from the above description and the drawings that the invention meets its objectives. It provides simple means for opening lift tab containers. The tabs are returned essentially to their pre-opening position after the opening is complete. Minimum effort and dexterity are required.

It will be understood by those skilled in the art that other embodiments of the invention and modifications of those described are possible within the scope of the invention. For example, adaptors may be provided for adapting the apparatus to be attached to surfaces other than vertical as shown in the drawings, such as horizontal surfaces, or the apparatus itself may be configured for such alternate attachments. Therefore, the scope of the invention is limited only by the appended claims.

What is claimed is:

1. Apparatus attachable to a support surface and enabling opening a lift-tab container with only one hand, said container having a top surface and a lift tab attached to said top, said container being openable by lifting of said tab, said apparatus comprising:

a base, first means for lifting said lift tab, second means for depressing said lift tab, structural means supporting said first and second means from said base, said first means being oriented such that with said top surface placed in contact with said first means and said container moved toward said base, said lift tab is lifted, said second means being oriented such that when said container is moved away from said base, said lift tab is depressed, 2. The apparatus of claim 1 in which:

said base is essentially planar, said structural means is essentially planar, said structural means is attached to and essentially perpendicular to said base, and is oriented essentially to a horizontal plane and has a lower surface, said first means projects a first distance downward from said lower surface at a second distance away from said base, said second means projects a third distance downward from said lower surface at a fourth distance away from said base, said first distance being greater than said third distance, said fourth distance being greater than said second distnce, said first means having a first bottom surface, a first edge of said surface and a first sloping surface, said first edge being parallel to said base and said structural means, said first sloping surface starting at said first edge facing away from said base and sloping upward toward said base, said second means having a second bottom surface, a second edge of said second surface, and a second sloping surface, said second sloping surface starting at said second edge, facing said base and sloping upward toward said base, whereby with said top surface in contact with said first bottom surface, motion of said container toward said base causes said tab to move under said second means toward said first means and said first edge to engage said lift tab and said sloping surface causes said lift tab to be lifted and whereby motion of said container away from said base causes said second sloping surface to engage said lifted lift tab and depress it.

3. Apparatus, attachable to a support surface, for opening a lift-tab container, said container having a top with said lift tab fastened to said top, essentially parallel to it, having a lifting end and being situated a distance X from said top, said distance X being in the range of 0.001 to 0.10 inches, said lift tab having a top extremity, said top extremity being a distance Y away from said top surface, said apparatus comprising:

a base oriented essentially vertical when said apparatus is in and attachable to a vertical surface to support said apparatus, a structural member extending essentially at a right angle to base and supported by it, a first cam supported by said structural member and positioned first distance from said base, a second cam supported by said structural member and positioned a second distance from said base, said second distance being greater than said first distance, said first cam having first a bottom surface and a first face facing away from said base and sloping downward from said structural member and away from said base to a juncture with said bottom surface, said juncture being an edge essentially parallel to said vertical surface and oriented essentially horizontally, said second cam having a second bottom surface and a second sloping surface facing toward said base and sloping downward from said structural member and away from said base to a juncture with said second bottom surface, said first cam extending a first distance downward from said structural member, said second cam extending a second distance downward from said structural member, said first distance exceeding said second distance by said distance Y, whereby, with said top surface of said container oriented horizontally and in contact with said first bottom surface and said container moved toward said base, said lifting end passes below said second cam and engages said first cam, moves up said first face, thus moving said lifting end away from said top, causing said lifting tab to be lifted to open said container and whereby, said lifting end now being moved away from said top surface, when said container is moved away from said base, said lifting end engages said second slopiog surface and is moved toward said top surface until it is essentially at distance X from said surface.

4. The apparatus of claim 1 in which said second means is configured to provide improved visibility of said first means.

5. The apparatus of claim 2, is which said second means is configured to provide improved visibility of said first means.

6. The apparatus of claim 3 in which second cam is configured to provide improved visibility of said edge.

7. The apparatus of claim 4 in which said structural means supporting said first and second means from said base provides an area suitable for the placement on it of advertising, logo display and the like.

8. The apparatus of claim 5 which said structural means supporting said first and second means from said base provides an area suitable for the placement on it of advertising, logo display and the like.

9. The apparatus of claim 6 in which said structural member provides an area suitable for the placement on it of advertising, logo display and the like.

10. The apparatus of claim 5 in which said planar base has an area sufficient to enable attachment of said apparatus to said support surface with adhesive tape.

11. The apparatus of claim 6 in which said base has an area sufficient to enable attachment of said apparatus to said support surface with adhesive tape.

12. The apparatus of claim 8 in which said planar base has an area sufficient to enable attachment of said apparatus to said support surface with adhesive tape.

13. The apparatus of claim 9 in which said base has an area sufficient to enable attacment of said apparatus to said support surface with adhesive tape.

* * * * *